US006913520B1

(12) United States Patent
Liao et al.

(10) Patent No.: US 6,913,520 B1
(45) Date of Patent: Jul. 5, 2005

(54) ALL-IN-ONE POLISHING PROCESS FOR A SEMICONDUCTOR WAFER

(75) Inventors: Mu-Liang Liao, Hsin-Chu Hsien (TW); Chi-Piao Cheng, Taipei (TW); Te-Sung Hung, Hsin-Chu (TW); Yung-Chieh Kuo, Taipei (TW)

(73) Assignee: United Microelectronics Corp., Hsin-Chu (TW)

( * ) Notice: Subject to any disclaimer, the term of this patent is extended or adjusted under 35 U.S.C. 154(b) by 0 days.

(21) Appl. No.: 10/707,838

(22) Filed: Jan. 16, 2004

(51) Int. Cl.[7] ..... B24B 1/00

(52) U.S. Cl. ..... 451/41; 451/44; 451/63; 451/65

(58) Field of Search ..... 451/41, 44, 60, 451/63, 65, 242, 246, 254, 258, 285, 287, 451/446

(56) References Cited

U.S. PATENT DOCUMENTS 5,725,414 A * 3/1998 Moinpour et al. ..... 451/41
5,868,857 A * 2/1999 Moinpour et al. ..... 134/6
6,267,648 B1 * 7/2001 Katayama et al. ..... 451/44
6,334,229 B1 * 1/2002 Moinpour et al. ..... 15/77
6,357,071 B2 * 3/2002 Moinpour et al. ..... 15/102
6,431,961 B1 * 8/2002 Katayama et al. ..... 451/44
6,475,293 B1 * 11/2002 Moinpour et al. ..... 134/6
6,558,239 B2 * 5/2003 Kunisawa et al. ..... 451/303
6,722,964 B2 * 4/2004 Kimura et al. ..... 451/285
6,777,338 B2 * 8/2004 Ashjaee et al. ..... 438/692
2003/0134570 A1 * 7/2003 Hakomori ..... 451/5
2004/0149584 A1 * 8/2004 Nagai et al. ..... 205/103
2004/0166783 A1 * 8/2004 Kimura et al. ..... 451/41
2004/0170753 A1 * 9/2004 Basol ..... 427/58
2004/0170766 A1 * 9/2004 Inoue et al. ..... 427/355
2004/0173666 A1 * 9/2004 Fukunaga et al. ..... 228/202

* cited by examiner

*Primary Examiner*—David B. Thomas
(74) *Attorney, Agent, or Firm*—Winston Hsu

(57) ABSTRACT

A semiconductor wafer has a top surface and an edge bevel surface, and a first material layer and a second material layer are respectively formed on the top surface and the edge bevel surface. A surface chemical mechanical polishing (surface CMP) process is performed to polish and remove portions of the first material layer down to a first thickness, and a rim CMP process is performed to completely remove the second material layer on the edge bevel surface down to the edge bevel surface thereafter to achieve a smooth surface of the edge bevel surface. Finally, a chemical cleaning process is performed to clean the edge bevel surface and the top surface, and the semiconductor wafer is dried thereafter.

22 Claims, 9 Drawing Sheets

ALL-IN-ONE POLISHING PROCESS FOR A SEMICONDUCTOR WAFER

BACKGROUND OF INVENTION

1. Field of the Invention

The present invention relates to an all-in-one polishing process for a semiconductor wafer, and more specifically, to a method of performing two chemical mechanical polishing (CMP) processes to respectively polish a top surface and an edge bevel surface of the semiconductor wafer, and performing a cleaning process and a drying process thereafter.

2. Description of the Prior Art

Chemical mechanical polishing (CMP) is a method of polishing materials, such as a semiconductor wafer, to a high degree of planarity and uniformity. The process is used to planarize a semiconductor wafer prior to the fabrication of microelectronic circuitry thereon, and is also used to remove high-elevation features created during the fabrication of the microelectronic circuitry on the surface of the semiconductor wafer.

Please refer to FIG. 1 and FIG. 2, which respectively present a top view and a cross-sectional view of a semiconductor wafer 10 according to the prior art. As shown in FIG. 1 and FIG. 2, the semiconductor wafer 10 comprises a top surface 10*a*, an edge bevel surface 10*b* and a bottom surface 10*c*, and the edge bevel surface 10*b* comprises a front side bevel 10*b*1, a backside bevel 10*b*2 and an edge 10*b*3. The top surface 10*a* comprises at least a first material layer 12, comprising at least a semiconductor structure (not shown), such as a dual damascene structure or a capacitor structure, on the top surface 10*a*, and the edge bevel surface 10*b* comprises a second material layer 14, either spontaneously formed with the first material layer 12 or formed prior to the formation of the first material layer 12, needing to be completely removed due to the product specification. Either the first material layer 12 or the second material layer 14 comprises either a dielectric layer or a metal layer, and is formed by performing either a chemical vapor deposition (CVD) process or an electric copper plating (ECP) process. In the preferred embodiment of the present invention, the first material layer 12 and the second material layer 14 are respectively composed of two different materials. Alternatively, the first material layer 12 and the second material layer 14 are composed of a same material. In addition, the edge 10*b*3 of the semiconductor wafer 10 comprises a notch 16 for locating the coordination of the semiconductor wafer 10 during the polishing and cleaning of the semiconductor wafer 10.

Please refer to FIG. 3 of a schematic view of a chemical mechanical polishing device (CMP device) 20 according to the prior art. As shown in FIG. 3, the CMP device comprises a polishing plate 22, a polishing pad 24 disposed on the polishing plate 22, a head 28 for pressing the semiconductor wafer 10 onto the polishing pad 24, a slurry supply tube 30, a cleaning solution supply tube 26 and a conditioner 32 for controlling the polishing pad 24 and removing flakes generated during polishing of the semiconductor wafer 10. The head 28 comprises a holder (not shown) for containing the semiconductor wafer 10, the slurry supply tube 30 provides slurry on the semiconductor wafer during the polishing of the semiconductor wafer 10, and the cleaning solution supply tube 26 provides either a cleaning solution (not shown) or deionized water (DI water, not shown), during the cleaning of the semiconductor wafer 10 and the polishing pad 24.

The method of polishing and cleaning the semiconductor wafer 10 according to the prior art begins with adding the slurry on the top surface 10*a* of the semiconductor wafer 10. A CMP process is then performed by utilizing the polishing pad 24 of the CMP device to polishing portions of the first material layer 12 down to a first thickness based on the produce requirement, and the semiconductor wafer is sent to a buffing pad (not shown) softer than the polishing pad 24 thereafter. A buffing process, utilizing either the cleaning solution or DI wafer provided by the cleaning solution supply tube 26, is then performed to remove flakes of the first material layer 12 and residual slurry on the top surface 10*a* of the semiconductor wafer 10.

Finally, a chemical cleaning process and a drying process are performed to clean and dry the semiconductor wafer 10, as shown in FIG. 4 of the cross-sectional view of the polished and cleaning semiconductor wafer 10.

However, as shown in FIG. 4, the second material layer 14 needing to be completely removed remains on the edge bevel surface 10*b* after portions of the first material layer 12 are removed down to the first thickness and the cleaning process is performed to cleaning the semiconductor wafer 10. Pealing of the remaining second material layer 14 frequently occurs in subsequent process due to thermal stress or other reasons, leading to the cracking of the second material layer 14. Flakes and particles of the second material layer 14 caused by the cracking thereof frequently fall on and therefore contaminate a top surface of another semiconductor wafer adjacent to the semiconductor wafer 10 during either a CVD process or the transportation of a batch of semiconductor wafers, making the performance of the product defective.

SUMMARY OF INVENTION

It is therefore a primary object of the present invention to provide an all-in-one polishing process for a semiconductor wafer so as to prevent a residual second material layer on the semiconductor in the method of polishing and cleaning a semiconductor wafer according to the prior art.

According to the claimed invention, the semiconductor wafer is positioned on a wafer stage of a chemical mechanical polishing (CMP) device and comprises a top surface, a bottom surface and an edge bevel surface. The top surface comprises at least a first material layer, and the edge bevel surface comprises a second material layer. By utilizing a polishing pad to perform a surface CMP process, portions of the first material layer on the top surface is removed down to a first thickness. A rim CMP process is then performed to completely remove the second material layer on the edge bevel surface. A surface buffing process is performed by spraying either a cleaning solution or deionized water (DI water) on the semiconductor wafer thereafter to remove the slurry as well as the flakes of the second material layer. Finally, a chemical cleaning process is performed to clean the semiconductor wafer, and the semiconductor wafer is dried thereafter.

It is an advantage of the present invention against the prior art that the surface CMP and the rim CMP processes are performed to respectively polish the first material layer on the top surface down to the first thickness and completely remove the second material layer on the edge bevel surface 50*b*, and the CMP device employed comprises at least one cleaning solution supply tube and is considered an improved apparatus capable of performing not only the surface CMP process and the rim CMP process but also a second cleaning process for cleaning the top surface and the chemical cleaning process. Therefore, the method of polishing the semiconductor wafer revealed in the present invention is called an all-in-one technology comprising the surface CMP process, the rim CMP process, the chemical cleaning process and the second cleaning process. In addition, the rim CMP process is employed to completely remove the second material layer. Contaminant caused by the pealed flakes of the residual second material layer due to thermal stress or other reasons in subsequent processes as revealed in the prior art is therefore prevented, assuring the performance of the product.

These and other objectives of the present invention will no doubt become obvious to those of ordinary skill in the art after reading the following detailed description of the preferred embodiment, which is illustrated in the multiple figures and drawings.

DETAILED DESCRIPTION

Figure 1:
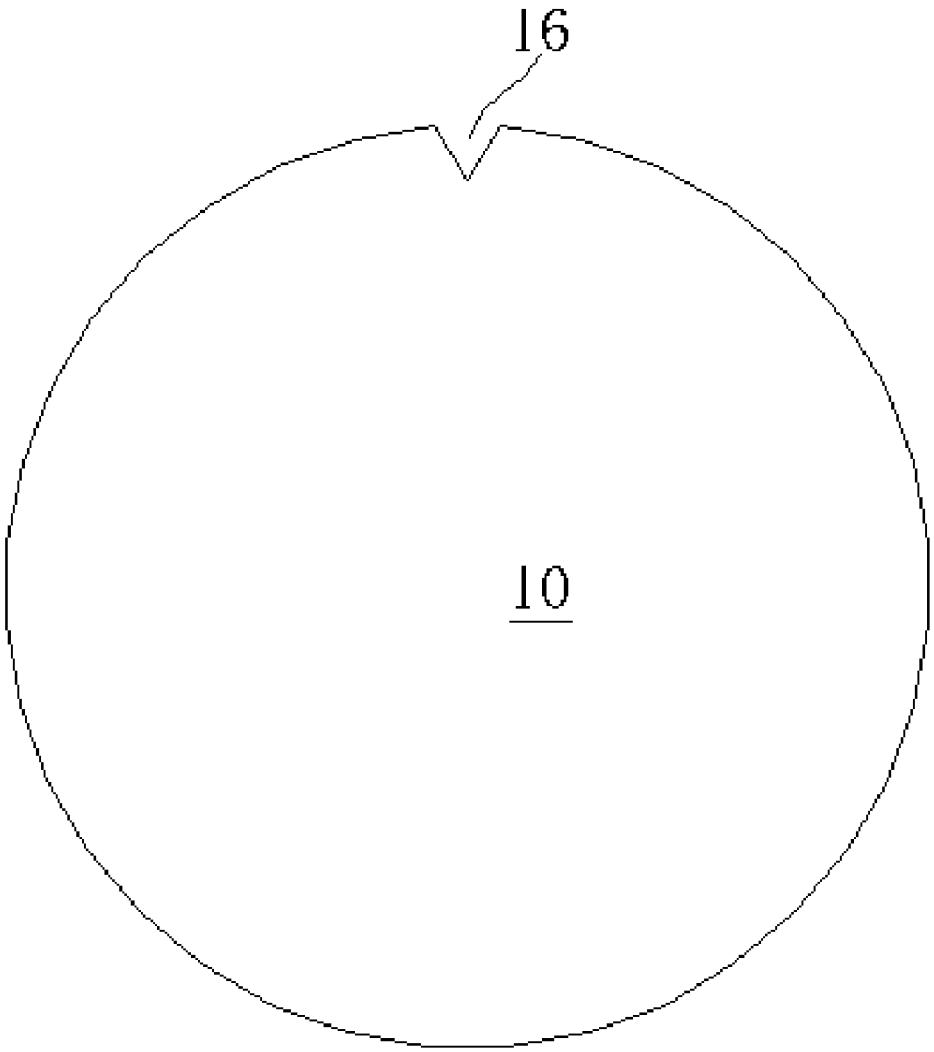
Fig. 1 Prior art
FIG. 1 is a top view of a semiconductor wafer according to the prior art.
Figure 2:
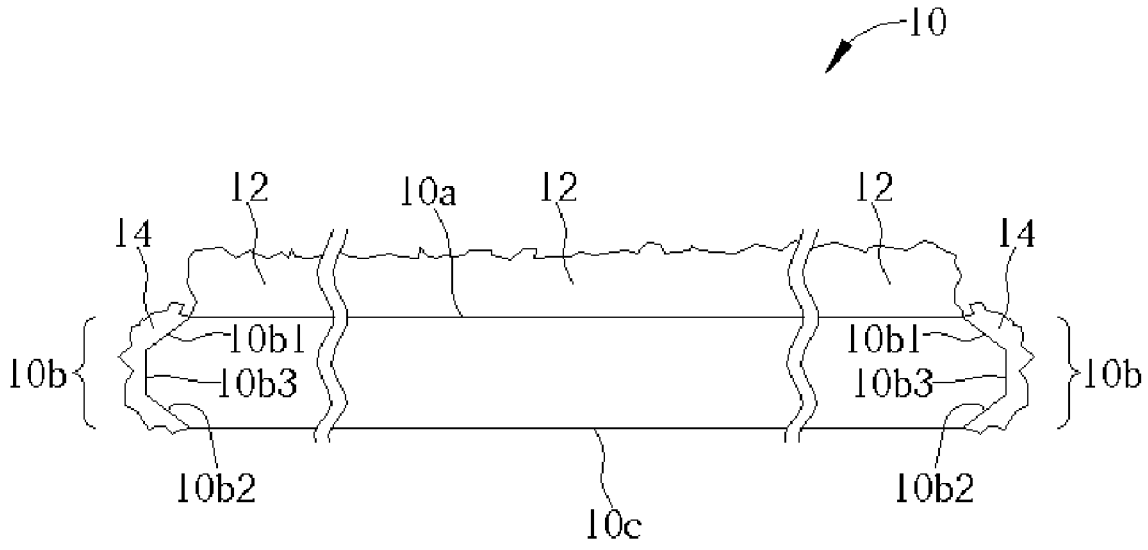
Fig. 2 Prior art
FIG. 2 is a cross-sectional view of the semiconductor wafer according to the prior art.
Figure 3:
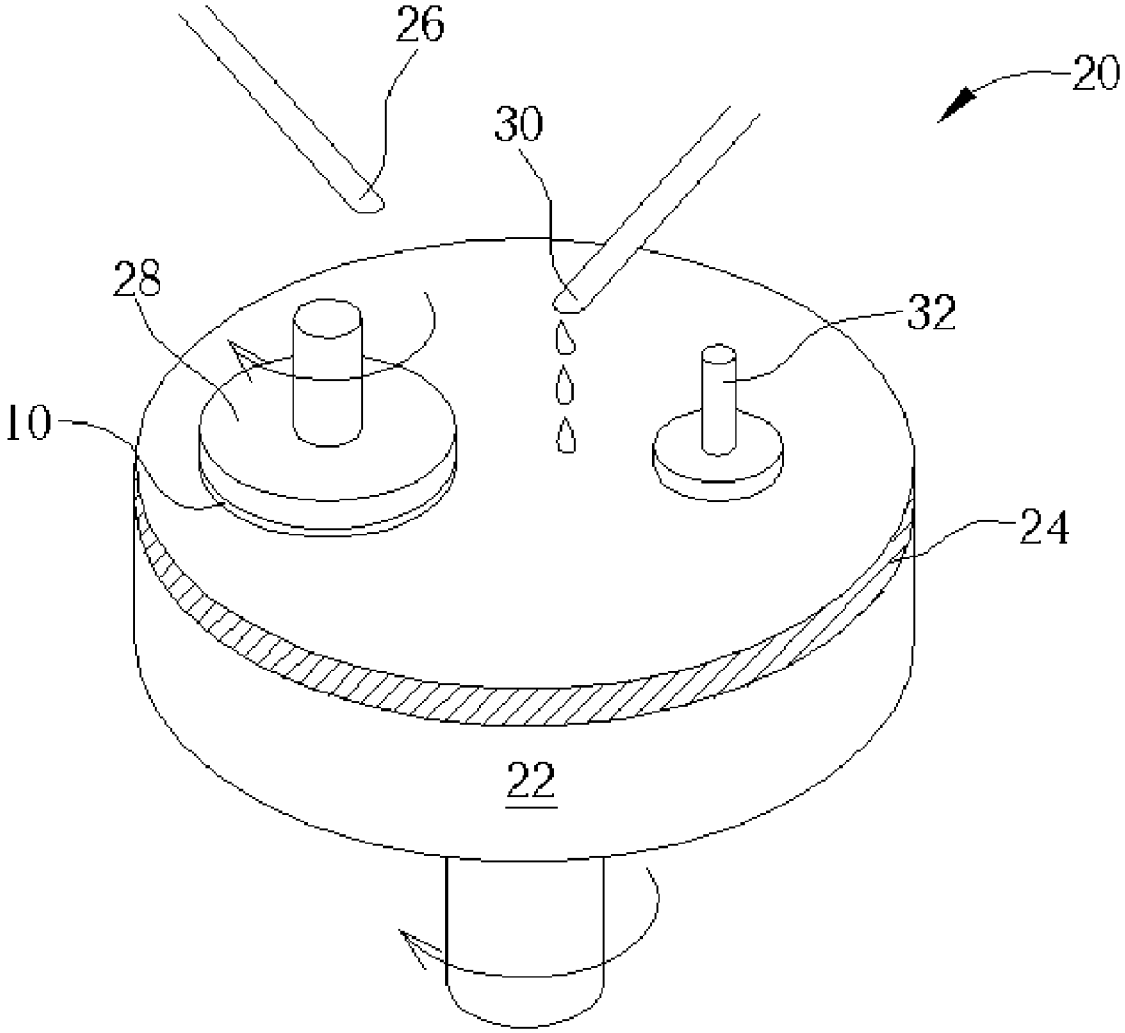
Fig. 3 Prior art
FIG. 3 is a schematic view of a chemical mechanical polishing device (CMP device) according to the prior art.
Figure 4:
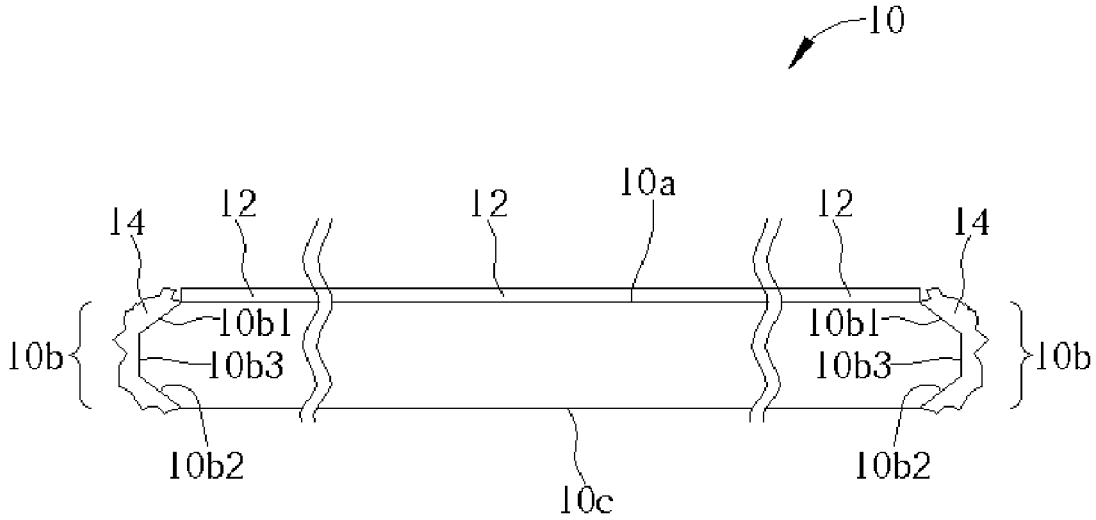
Fig. 4 Prior art
FIG. 4 is the cross-sectional view of the polished and cleaning semiconductor wafer according to the prior art.
Figure 5:
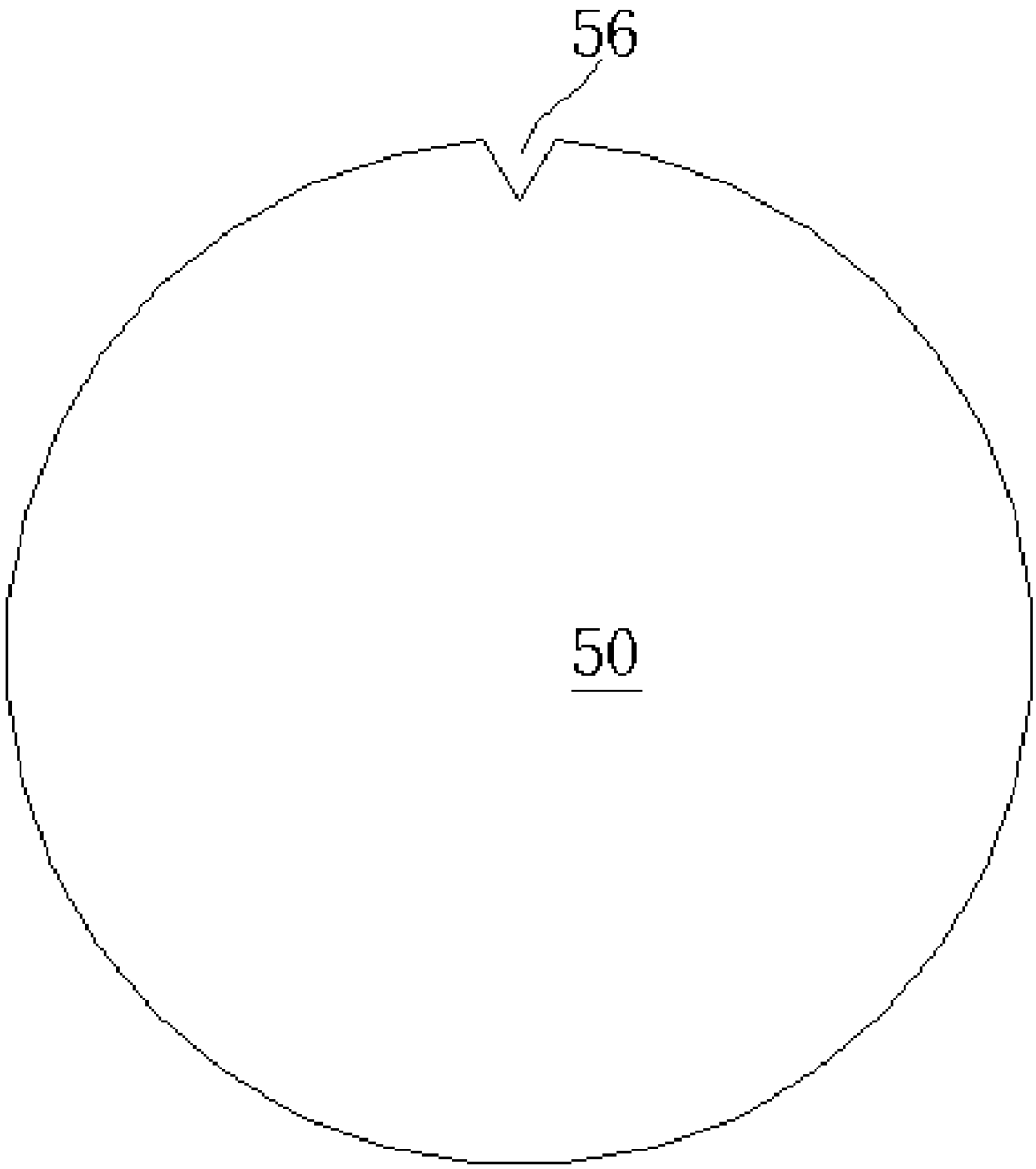
FIG. 5 is the top view of a semiconductor wafer according to the present invention.
Figure 6:
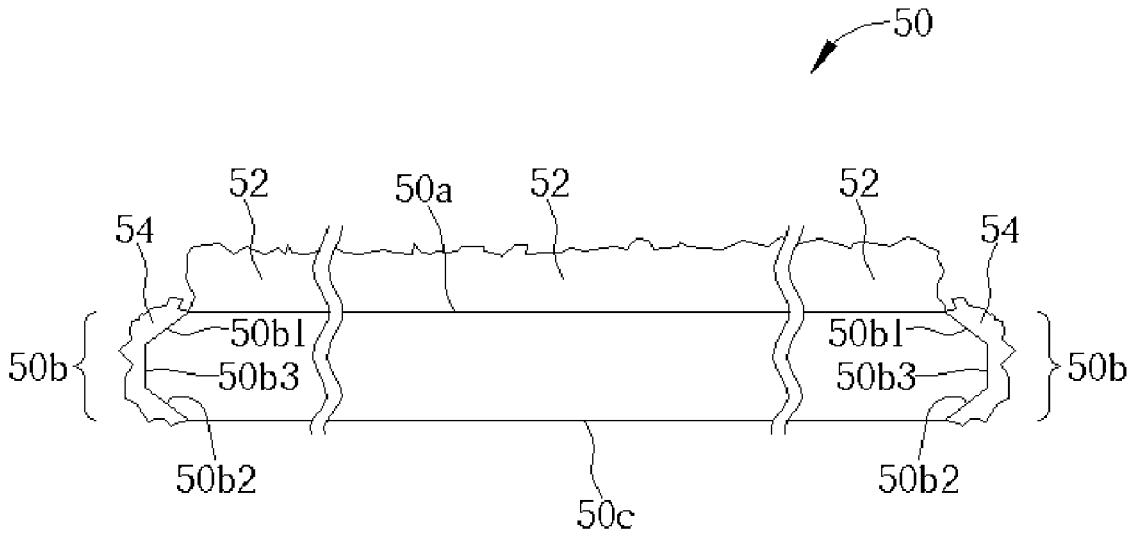
FIG. 6 is the cross-sectional view of a semiconductor wafer according to the present invention.

Please refer to FIG. 5 and FIG. 6, which respectively represent a top view and a cross-sectional view of a semiconductor wafer 50 according to the present invention. As shown in FIG. 5 and FIG. 6, the semiconductor wafer 50 comprises a top surface 50*a*, a edge bevel surface 50*b* located at the rim of the semiconductor wafer 50, and a bottom surface 50*c*. The edge bevel surface 50*b* has a width of several millimeters and comprises a front side bevel 50*b*1, a backside bevel 50*b*2 and an edge 50*b*3. Normally, the edge bevel surface 50*b* can be employed for the alignment of the semiconductor wafer 50 to manufacturing machines during various semiconductor processes. The top surface 50*a* comprises at least a first material layer 52 formed on the top surface 50*a*, and the first material layer 52 comprises a semiconductor structure (not shown), such as a dual damascene structure or a capacitor structure. The edge bevel surface 50*b* comprises a second material layer 54, which is either spontaneously formed with the first material layer 52 or formed prior to the formation of the first material layer 52, needing to be completely removed due to the product specification. Either the first material layer 52 or the second material layer 54 comprises either a dielectric layer or a metal layer, and either the first material layer 52 or the second material layer 54 is formed by processes with full coverage, such as a chemical vapor deposition (CVD) process or an electric copper plating (ECP) process. In the preferred embodiment of the present invention, the first material layer 52 and the second material layer 54 are respectively composed of two different materials. Alternatively, the first material layer 52 and the second material layer 54 are composed of a same material. In addition, the edge 50*b*3 of the semiconductor wafer 50 comprises a notch 56 for locating the coordination of the semiconductor wafer 50 during the polishing and cleaning of the semiconductor wafer 50.

After adding a first slurry (not shown) on the top surface 50*a* of the semiconductor wafer 50, a surface chemical mechanical polishing (surface CMP) process is performed to remove portions of the first material layer 52 on the top surface 50*a* down to a first thickness according to the specification requirement of the product. A first cleaning solution (not shown), comprising deionized water (DI water), is then sprayed onto the top surface 50*a* of the semiconductor wafer 50, and a surface cleaning process is performed to remove residual first slurry and flakes of the first material layer 52.

Figure 7:
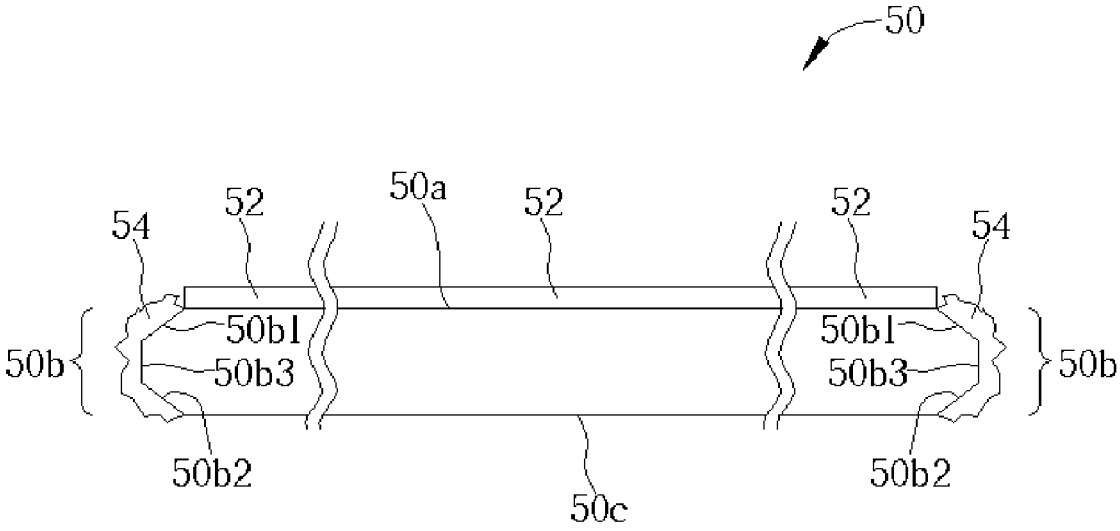
FIG. 7 is the cross-sectional view of the semiconductor wafer after the surface CMP process and the surface cleaning process according to the present invention.

Please refer to FIG. 7 of the cross-sectional view of the semiconductor wafer 50 after the surface CMP process and the surface cleaning process are performed according to the present invention. As shown in FIG. 7, the top surface 50*a* of the semiconductor wafer 50 turns to be a flat surface after the surface CMP process and the surface cleaning process are performed. The steps and devices utilized for the performance of the surface CMP process and the surface cleaning process are similar to those revealed in the prior art, and are therefore neglected for simplicity of description.

Figure 8:
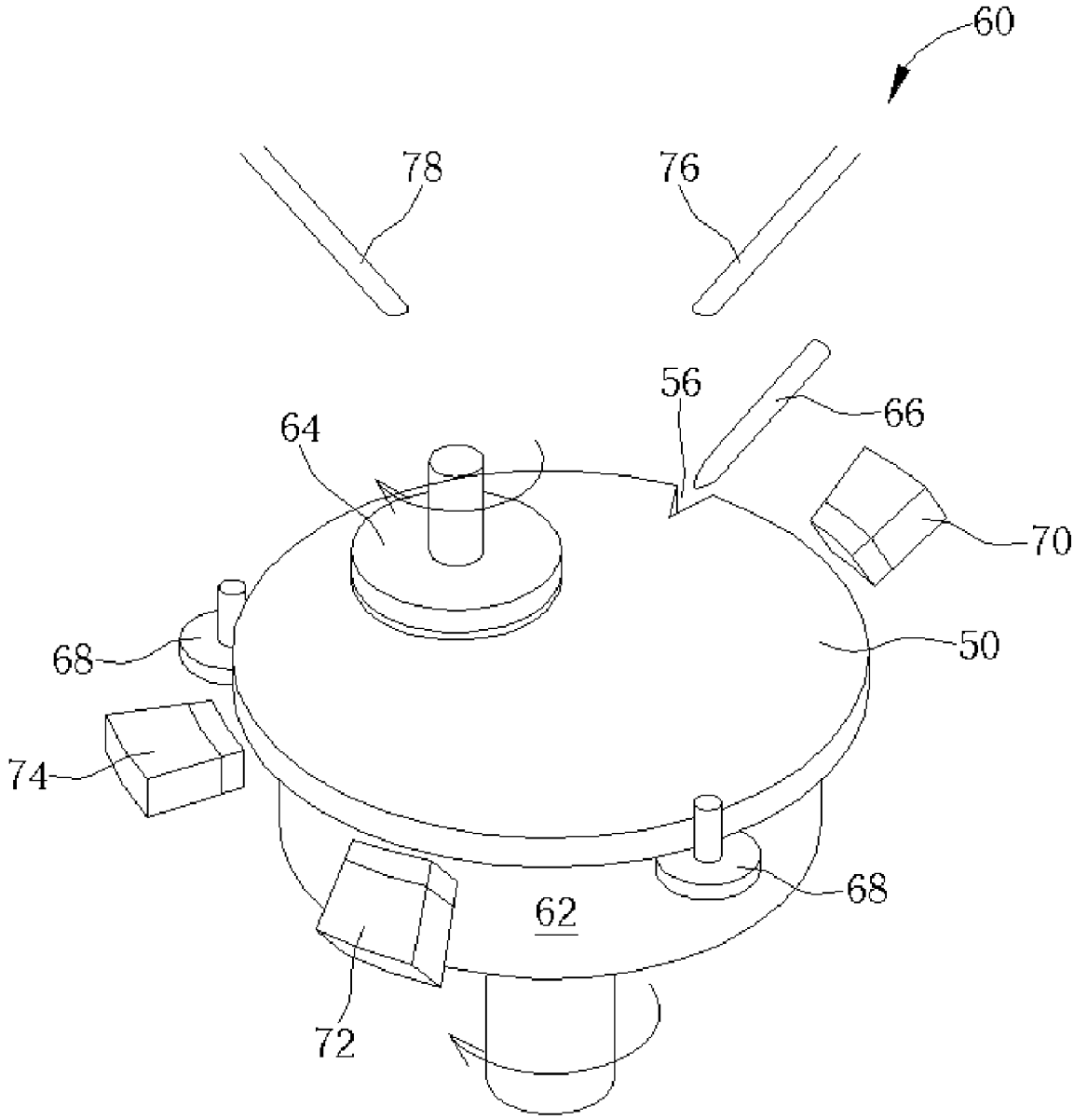
FIG. 8 is the schematic view of a rim CMP device employed in the all-in-one polishing process according to the present invention.

Please refer to FIG. 8 of a schematic view of a rim chemical mechanical polishing device (rim CMP device) 60 employed in the all-in-one polishing process for the semiconductor wafer 50 according to the present invention. As shown in FIG. 8, the rim CMP device 60 comprises a wafer stage 62, a buffing pad 64, a notch pad 66, a plurality of rollers 68, at least one front side bevel pad 70, at least one backside bevel pad 72, at least one edge pad 74, at least one slurry supply tube 76 and at least one cleaning solution supply tube 78. The wafer stage 62 is employed for containing the semiconductor wafer 50, the notch pad 66 is employed for locating the coordination of the semiconductor wafer 50 on the wafer stage 62, and the rollers 68 are employed for fixing the semiconductor wafer 50 on the wafer stage 62. The slurry supply tube 76 provides a second slurry (not shown) on the semiconductor wafer 50 during the polishing of the second material layer 54, and the cleaning solution supply tube 78 provides a second cleaning solution (not shown), comprising either chemicals or DI water, during the cleaning of the semiconductor wafer 50.

Figure 9:
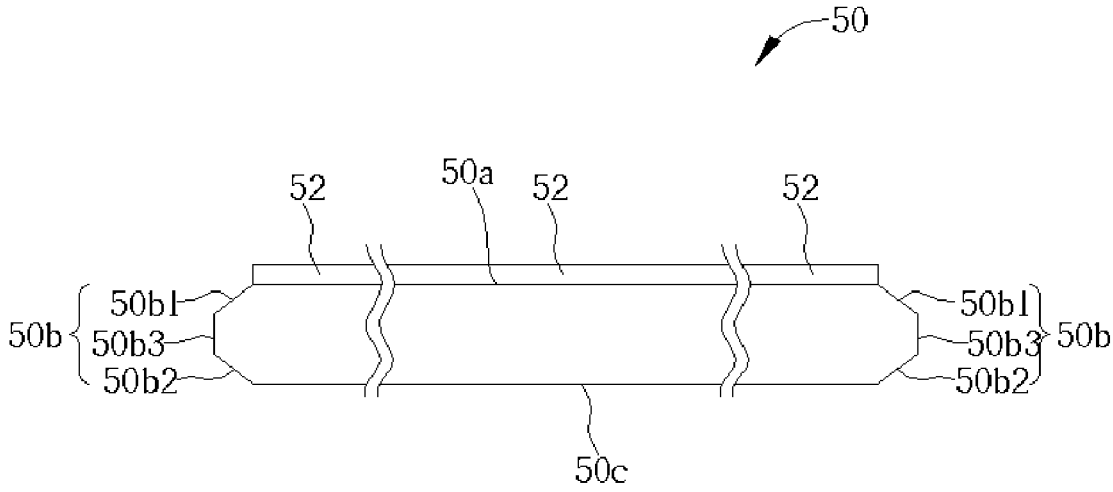
FIG. 9 is the schematic view of the rim CMP process of the all-in-one polishing process according to the present invention.

Please refer to FIG. 9 of the schematic view of the rim CMP process of the all-in-one polishing process for the semiconductor wafer 50 according to the present invention. As shown in FIG. 9, the second slurry provided by the slurry supply tube 76 is then added onto the edge bevel surface 50*b* of the semiconductor wafer 50, and the rim CMP process is performed thereafter to polish and completely remove portions of the second material layer 54 respectively on the front side bevel 50*b*1, the backside bevel 50*b*2 and the edge 50*b*3 by utilizing the front side bevel pad 70, the backside bevel pad 72 and the edge pad 74, respectively. In the preferred embodiment of the present invention, an angle between the semiconductor wafer 50 and either the front side bevel pad 70 or the backside bevel pad 72 ranges between 15 to 28 degrees during the rim CMP process due to the slopes of the front side bevel 50*b*1 and the backside bevel 50*b*2 to the semiconductor wafer 50. Simultaneously, a buffing polishing process is optionally performed on the top surface 50*a* by utilizing the buffing pad 64 in order to achieve an excellent uniformity of the top surface 50*a*. A surface and edge bevel cleaning process, utilizing the cleaning solution provided by the cleaning solution supply tube 78, is then performed to clean the top surface 50*a*, the front side bevel 50*b*1, the backside bevel 50*b*2, the edge 50*b*3 and the surface of the semiconductor wafer, completely removing flakes of the second material layer 54 and residual portions of the second slurry on the top surface 50*a*, the front side bevel 50*b*1, the backside bevel 50*b*2, the edge 50*b*3 and the surface of the semiconductor wafer, as shown in FIG. 9.

Finally, a chemical cleaning process and a drying process are performed to respectively remove residual slurry and dry the semiconductor wafer 50 at the end of the method revealed in the present invention.

In another embodiment of the present invention, the rim CMP process and the edge bevel cleaning process are alternatively performed on the edge bevel surface 50*b* of the semiconductor wafer 50 before the surface CMP process, the buffing polishing process and the surface cleaning process are performed on the top surface 50*a* of the semiconductor wafer 50, and the chemical cleaning process and the drying process are then performed to respectively clean and dry the semiconductor wafer 50. The tools and steps utilized in the rim CMP process, the edge bevel cleaning process, the surface CMP process, the surface cleaning process and the drying process are similar to those in the preferred embodiment of the present invention and are neglected for simplicity of description.

In comparison with the prior art, the present invention utilizes the surface CMP and the rim CMP processes to respectively polish the first material layer 52 on the top surface 50*a* down to the first thickness and completely remove the second material layer 54 on the edge bevel surface 50*b*, and the CMP device 60 employed comprises the buffing pad 64 and is considered an improved apparatus capable of performing not only the surface CMP process and the rim CMP process but also the surface cleaning process and the edge bevel cleaning process without introducing additional manufacturing machines or processes that may increase production cost. Therefore, the method of polishing the semiconductor wafer 50 revealed in the present invention is called an all-in-one technology comprising the surface CMP process, the rim CMP process, the surface cleaning process and the edge bevel cleaning process. In addition, the rim CMP process is employed to completely remove the second material layer 54. Contaminant caused by the pealed flakes of the residual second material layer 14 due to thermal stress or other reasons in subsequent processes as revealed in the prior art is therefore prevented because of the improved uniformity of the edge bevel surface 50*b* achieved by the rim CMP process and the edge bevel cleaning process revealed in the present invention, assuring the performance of the product.

Those skilled in the art will readily observe that numerous modifications and alterations of the device may be made while retaining the teachings of the invention. Accordingly, the above disclosure should be construed as limited only by the metes and bound of the appended claims.

What is claimed is:

1. An all-in-one polishing process for a semiconductor wafer, the semiconductor wafer being positioned on a polishing platen of a chemical mechanical polishing (CMP) device and comprising a top surface, a bottom surface and an edge bevel surface, the edge bevel surface comprising a front side bevel, a backside bevel and an edge, the top surface comprising at least a first material layer, the edge bevel surface comprising a second material layer, the polishing process comprising:

performing a surface CMP process by utilizing a polishing pad to remove the fist material layer on the top surface to a first thickness;

performing a first cleaning process to clean the top surface of the semiconductor wafer;

performing a buffing polishing process by utilizing a buffing pad;

performing a rim CMP process to completely remove the second material layer on the front side bevel, the backside bevel and the edge;

performing a second cleaning process to clean the top surface, the front side bevel, the backside bevel, the edge, and the surface of the semiconductor wafer; and drying the semiconductor wafer.

2. The polishing process of claim 1 wherein either the first material layer or the second material layer comprises either a dielectric layer or a metal layer.

3. The polishing process of claim 1 wherein either the first material layer or the second material layer is formed by performing either a chemical vapor deposition (CVD) process or an electric copper plating (ECP) process.

4. The polishing process of claim 1 wherein the surface CMP process and the rim CMP process are performed by utilizing slurry.

5. The polishing process of claim 4 wherein the rim CMP process is performed by utilizing at least one front side bevel pad, at least one backside bevel pad and at least one edge pad to polish and completely remove portions of the second material layer respectively on the front side bevel, the backside bevel and the edge of the semiconductor wafer.

6. The polishing process of claim 1 wherein the first and second cleaning processes are performed by utilizing deionized water (DI water) to remove the residual slurry on the semiconductor wafer and flakes of the first and second material layers respectively on the top surface and the edge bevel surface of the semiconductor wafer.

7. An all-in-one apparatus for polishing a semiconductor wafer, the semiconductor wafer comprising a top surface, a bottom surface and an edge bevel surface, the edge bevel surface comprising a front side bevel, a backside bevel and an edge, the top surface comprising at least one first material layer, the edge bevel surface comprising a second material layer, the apparatus comprising:

a polishing platen;

a wafer stage for containing the semiconductor wafer;

a polishing pad for polishing the first material layer on the top surface to a first thickness;

a notch pad for locating the coordination of the semiconductor wafer on the wafer stage;

a plurality of rollers for fixing the semiconductor wafer on the wafer stage;

at least one front side bevel pad for completely removing portions of the second material layer on the front side bevel;

at least one backside bevel pad for completely removing portions of the second material layer on the backside bevel;

at least one edge pad for completely removing portions of the second material layer on the edge;

at least one slurry supply tube for providing slurry on the semiconductor wafer, the buffing pad, the front side bevel pad, the backside bevel pad and the edge pad; and at least one cleaning solution supply tube for providing a cleaning solution for cleaning the semiconductor wafer.

8. The all-in-one apparatus of claim 7 wherein the edge of the semiconductor wafer comprises a notch for engaging with the notch pad to locate the coordination of the semiconductor wafer on the wafer stage.

9. The all-in-one apparatus of claim 7 wherein either the first material layer or the second material layer comprises either a dielectric layer or a metal layer.

10. The all-in-one apparatus of claim 7 wherein either the first material layer or the second material layer is formed by performing either a CVD process or an ECP process.

11. The all-in-one apparatus of claim 7 wherein the cleaning solution is DI water for removing the slurry on the semiconductor wafer and flakes of the first and second material layers respectively on the top surface and the edge bevel surface of the semiconductor wafer.

12. The all-in-one apparatus of claim 7 wherein the all-in-one apparatus comprises a buffing pad for performing a buffering polishing process on the top surface of the semiconductor wafer.

13. An all-inone polishing process for a semiconductor wafer, the semiconductor wafer being positioned on a polishing platen of a CMP device and comprising a top surface, a bottom surface and an edge bevel surface, the edge bevel surface comprising a front side bevel, a backside bevel and an edge, the top surface comprising at least one first material layer, the edge bevel surface comprising a second material layer, the edge comprising a notch for engaging with a notch pad of the CMP device to locate the coordination of the semiconductor wafer on the wafer stage, the polishing process comprising:

performing a rim CMP process by utilizing at least one front side bevel pad, at least one backside bevel pad and at least one edge pad to polish and completely remove the second material layer respectively on the front side bevel, the backside bevel, and the edge of the semiconductor wafer;

performing a first cleaning process to clean the top surface, the front side bevel, the backside bevel and the edge of the semiconductor wafer; and drying the semiconductor wafer.

14. The polishing process of claim 13 wherein either the first material layer or the second material layer comprises either a dielectric layer or a metal layer.

15. The polishing process of claim 13 wherein either the first material layer or the second material layer is formed by performing either a CVD process or an ECP process.

16. The polishing process of claim 13 wherein slurry is employed to perform a surface CMP process by utilizing a buffing pad of the CMP device to remove the first material layer on the top surface to a first thickness before performing the rim CMP process, and a second cleaning process is performed by utilizing DI water to clean the top surface of the semiconductor wafer after performing the surface CMP process.

17. The polishing process of claim 16 wherein a buffing polishing process is performed on the top surface of the semiconductor wafer after the performance of the second cleaning solution by utilizing a buffing pad.

18. The polishing process of claim 13 wherein slurry is employed to perform a surface CMP process by utilizing a buffering pad of the CMP device to remove the first material layer on the top surface to a first thickness after performing the rim CMP process, and a second cleaning process is performed by utilizing DI water to clean the top surface of the semiconductor wafer after performing the surface CMP process.

19. The polishing process of claim 18 wherein a buffing polishing process is performed on the top surface of the semiconductor wafer after the performance of the second cleaning solution by utilizing a buffing pad.

20. The polishing process of claim 13 wherein the front side bevel pad, backside bevel pad, and the edge pad are separate from each other.

21. The polishing process of claim 20 wherein the rim CMP process is performed by utilizing slurry and the CMP device.

22. The polishing process of claim 21 wherein the first cleaning process is performed by utilizing DI water to remove the residual slurry and flakes of the second material layer on the edge bevel surface of the semiconductor wafer after the rim CMP process is performed.

* * * * *